US006826849B1

(12) United States Patent
Millonzi

(10) Patent No.: US 6,826,849 B1
(45) Date of Patent: Dec. 7, 2004

(54) CONTAMINATION-FREE PHOTORECEPTOR DRYING APPARATUS

(75) Inventor: Richard P. Millonzi, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/672,575

(22) Filed: Sep. 26, 2003

(51) Int. Cl.[7] ..... F26B 11/00
(52) U.S. Cl. ..... 34/187; 34/189; 34/218
(58) Field of Search ..... 34/68, 69, 187, 34/189, 201, 218; 118/423, 425; 399/250

(56) References Cited

U.S. PATENT DOCUMENTS

| | | | | | |
|---|---|---|---|---|---|
| 3,717,409 | A | * | 2/1973 | Hespenheide | 399/359 |
| 4,536,075 | A | * | 8/1985 | Hoffman | 399/236 |
| 4,788,786 | A | * | 12/1988 | Suter | 134/56 R |
| 5,273,583 | A | * | 12/1993 | Langlois et al. | 118/665 |
| 5,334,246 | A | | 8/1994 | Pietrzykowski, Jr. et al. | 118/69 |
| 5,419,058 | A | * | 5/1995 | Swain et al. | 34/186 |
| 5,604,990 | A | * | 2/1997 | Takekoshi | 34/68 |

* cited by examiner

*Primary Examiner*—Stephen Gravini
(74) *Attorney, Agent, or Firm*—Tallam I. Nguti

(57) ABSTRACT

A contamination-free apparatus is provided for moving and drying coated photoreceptors. The contamination free apparatus includes an oven assembly having first and second side walls defining a heating chamber, a guiding track for guiding a photoreceptor carrier or pallet, and first and second magnetic drive loops mounted externally of said first and second side walls. Each of the first and second magnetic loops has first magnetic elements for inducing magnetic forces into the heating chamber. The contamination-free apparatus also includes a carrier or a pallet for holding coated photoreceptors for movement through the heating chamber. The carrier or pallet includes track followers, first and second end walls for facing the first and second side walls of the heating chamber, and second magnetic elements. The second magnetic elements are mounted on the first and second end walls for coupling with the first magnetic elements and thus enabling the first and second magnetic loops to magnetically move the carrier means through the heating chamber. The contamination-free apparatus further includes an air bearing assembly for holding the track followers out of contact with the guiding track as the carrier or pallet is magnetically moved through the heating chamber.

14 Claims, 4 Drawing Sheets

CONTAMINATION-FREE PHOTORECEPTOR DRYING APPARATUS

The present invention relates to photoreceptor manufacturing, and more particularly, relates to a contamination-free apparatus for drying a dip coated photoreceptor or multi-layer optical photoconductive member, such as the type used in electrostatographic imaging systems.

Photoreceptors or photoconductive devices suitable for use in electrostatographic systems and machines are well known. Typically, such photoreceptors or photoconductive devices include coated photoconductive drums or coated hollow cylindrical members, that for example comprise a homogeneous coating layer of a single material such as vitreous selenium deposited onto a support substrate.

A dip coating process for manufacturing such photoconductive drums or such coated hollow cylindrical members is disclosed for example in U.S. Pat. No. 5,334,246, entitled "Coated drum photoreceptor manufacturing system" issued Aug. 2, 1994 to Pietrzykowski, Jr., et al. As disclosed therein, the dip coating system features a plurality of pipes or hollow cylinder photoreceptors that are suspended from a conventional carrier means or pallet for transport through various dip coating stations in a dip coating housing. In particular, the system includes a load/unload station, a vertical transport system and a horizontal transport system for transporting the conventional carrier means or pallet having photoreceptors loaded thereon through the various processing stations. The various processes of the system thus can be completed in an in-line configuration while the photoreceptors are attached to the conventional carrier means or pallet.

Currently, the horizontal transport system for moving the coated photoreceptors through high temperature drying oven includes mechanical moving components that are in contact with load-bearing surfaces. Some such moving components are not lubricated. As a result, the horizontal transport system is often subject to failure and significant downtime due to wear and tear of the non-lubricated components. The horizontal transport system as such is therefore also subject to a shortened life, and worse yet, its mechanical components are major sources of undesirable foreign material contaminates or contamination on the photoreceptors.

There is therefore a need for a contamination-free apparatus for drying dip coated photoreceptors in a photoreceptor manufacturing process such as the dip coating system above.

Thus in accordance with an aspect of the present disclosure, there is provided a contamination-free apparatus for moving and drying coated photoreceptors. The contamination free apparatus includes an oven assembly having first and second side walls defining a heating chamber, a guiding track for guiding a photoreceptor carrier or pallet, and first and second magnetic drive loops mounted externally of said first and second side walls. Each of the first and second magnetic loops has first magnetic elements for inducing magnetic forces into the heating chamber. The contamination-free apparatus also includes a carrier or a pallet for holding coated photoreceptors for movement through the heating chamber. The carrier or pallet includes track followers, first and second end walls for facing the first and second side walls of the heating chamber, and second magnetic elements. The second magnetic elements are mounted on the first and second end walls for coupling with the first magnetic elements and thus enabling the first and second magnetic loops to magnetically move the carrier means through the heating chamber. The contamination-free apparatus further includes an air bearing assembly for holding the track followers out of contact with the guiding track as the carrier or pallet is magnetically moved through the heating chamber.

The present invention will become apparent from the following description in conjunction with the accompanying drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
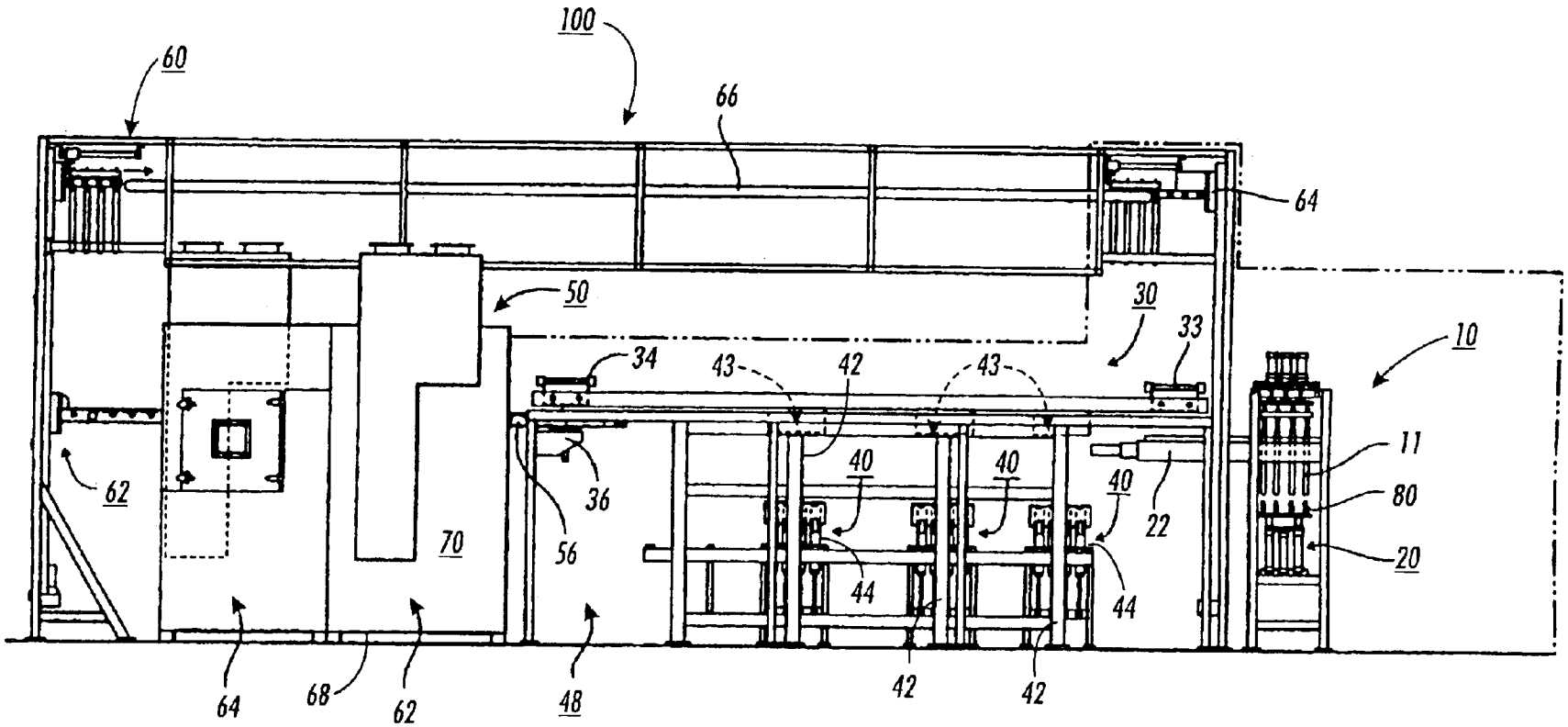
FIG. 1 is a schematic side view showing a coated drum photoreceptor manufacturing system including the contamination-free drying apparatus in accordance with the present invention.
Figure 2:
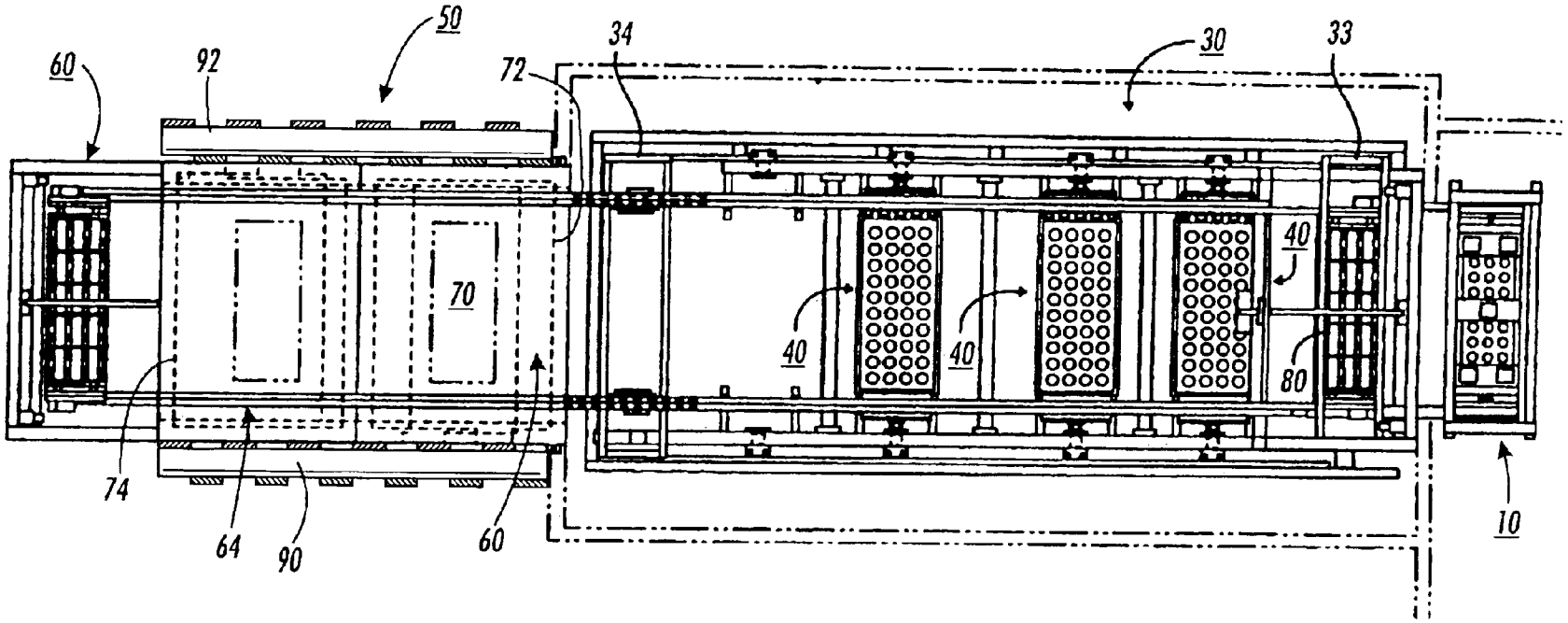
FIG. 2 is a schematic plan view of the coated drum photoreceptor manufacturing system of FIG. 1.

Referring now to the drawings in detail, reference is initially made to FIGS. 1 and 2 wherein a coated drum photoreceptor manufacturing system 100 including the contamination-free drying apparatus 50 of the present invention is illustrated. The coated drum photoreceptor manufacturing system 100 comprises a load/unload station 10, a dip coating cell 30, and a contamination-free drying apparatus 50. As can be seen in FIG. 1, the coated drum photoreceptor manufacturing system 100 may also include a return conveyor assembly. It will be noted that the load/unload station 10, the dip coating cell 30, and the contamination-free drying apparatus 50 are arranged in an in-line configuration, and that each are provided with transport means, as will be discussed in detail herein, for transporting articles to be dip coated from right to left through the various process stations of the manufacturing system.

For the purposes of describing the present invention, the functions of the individual processing locations 10, 30 and 50, insofar as they vary from one another, will be described individually. Thus, it will be understood that it may be desirable in some instances to use, for example, two or more process handling systems as shown in FIGS. 1 and 2, or variations thereof, in an in-line configuration to provide a streamlined and efficient system.

The load/unload station 10 also includes a chuck engage/disengage apparatus (not shown) and a load pallet vertical lift 20 that cooperate with the carrier means or pallet 80. The chuck engage/disengage apparatus (not shown) includes a contact plate 19 for pressing against the top of each mandrel to simultaneously actuate each chucking device. Thus, the chuck engage/disengage apparatus (not shown) and the loaded pallet vertical lift 20 operate interactively with the photoreceptors 11, to raise and load the photoreceptors, onto the carrier means or pallet 80, as well as to lower and unload the finished photoreceptors 11 from the carrier means or pallet 80. This load/unload operation is diagrammatically illustrated in FIGS. 3 and 4 by the contrasting offset positions of halves of the loaded pallet 80. Finally, the pallet load/unload station 10 also includes a carrier means or pallet horizontal transport 22 for transporting and transferring a loaded carrier means or pallet 80 from the load/unload station 10 to the dip coating cell 30.

The dip coat cell 30 includes an exchange platform 36 for transferring the carrier means or pallet to the contamination-free drying apparatus 50. The contamination-free drying apparatus 50 may be comprised of a separate and discrete drying oven unit 62 and cooler unit 64. The contamination-free drying apparatus includes a horizontal conveyor 56 for receiving the carrier means or pallet 80 from the dip cell 30 via exchange platform 36. No vertical transport system is required in the contamination-free drying apparatus 50 as each carrier means or pallet 80 is merely transported horizontally through the drying oven 62 and through the cooling booth 64 for predetermined specified periods of time. In the preferred embodiment, the temperature of the drying oven 62 will be controllable within a range between 80 degrees and 190 degrees centigrade, while the cooler will provide inlet air which is capable of being cooled to about 18 degrees centigrade. Accordingly, the compressed air used in the air bearing assembly as described below may need to be heated.

Initially, in the manufacturing system 100, photoreceptors 11 are delivered on a load pallet 16 to the load/unload station 10. The photoreceptors 11 are then elevated by means of vertical lift 20 (while still in of the loading pallet 80) and mounted individually onto individual mandrels of the carrier means or pallet 80 of the present invention. In one embodiment, a chucking device may be associated with each mandrel.

The loaded carrier means or pallet 80 is subsequently transported from the load/unload station 10 along a pallet horizontal transport system 22 to the dip coating cell 30. Preferably, the photoreceptors will be transported through an air curtain into the clean room environment of the dip coating cell 30 where the loaded carrier means or pallet 80 is transferred to a first horizontal transfer cart 33 of the dip horizontal transfer system 32. The first dip horizontal transfer cart 33 then transports the loaded carrier means or pallet 80 into position over a predetermined dip station 40. At this point, the carrier means or pallet 80 is transferred to a dip vertical transfer system 42 corresponding to the specific dip station 40 via a transfer system 43. The dip vertical transport 42 receives the carrier means or pallet 80 from the first dip horizontal transfer cart 33 and lowers the loaded carrier means or pallet 80 into the dip coating tank 44.

Thereafter, the first horizontal dip transfer cart 33 returns to its initial position for receiving subsequent carrier means or pallets 80, thereby providing a parallel processing capability within the dip coating cell 30. After a predetermined amount of time, the carrier means or pallet 80 that has been lowered down into the dip tank 44 is elevated by means of the dip vertical transfer system 42 and returned to the dip horizontal transfer system 32. A second dip horizontal transfer cart 34 is moved into position for receiving the carrier means or pallet 80 from the dip vertical transport 42, and for transporting the loaded carrier means or pallet to the next station, a flash-off station 48. After sufficient solvent dissipation at the flash-off station 48, the carrier means or pallet 80 is transferred via an exchange platform 36 to the contamination-free drying apparatus 50 of the present invention.

Figure 3:
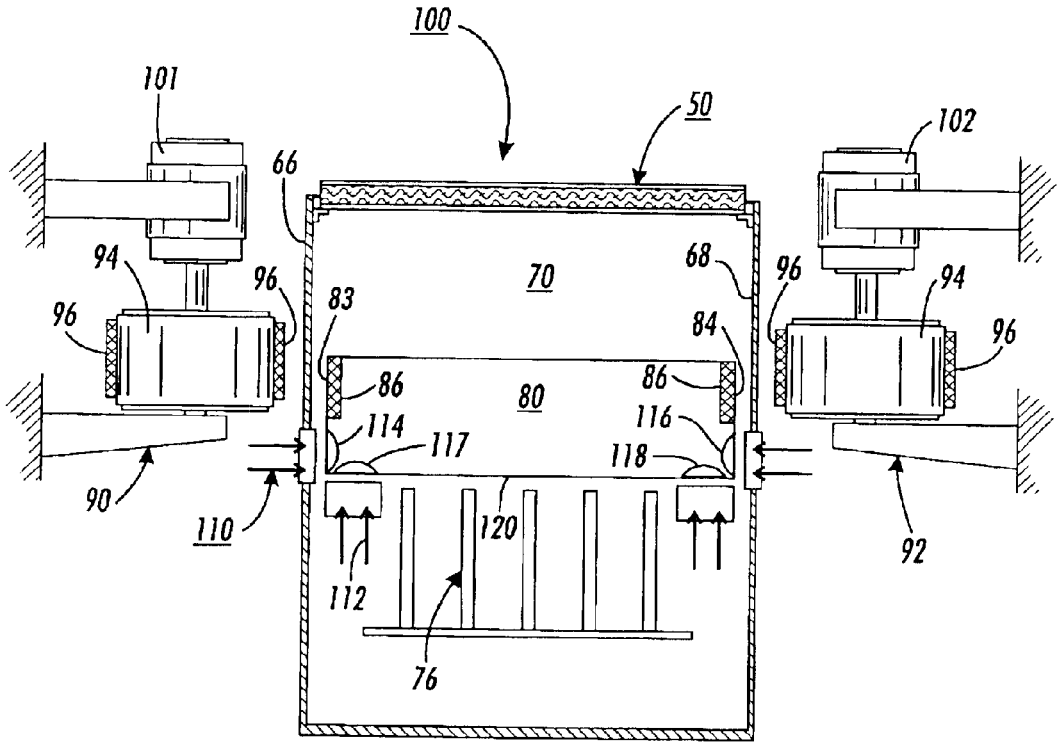
FIG. 3 is a schematic plan view of the contamination-free drying apparatus of the present invention.
Figure 4:
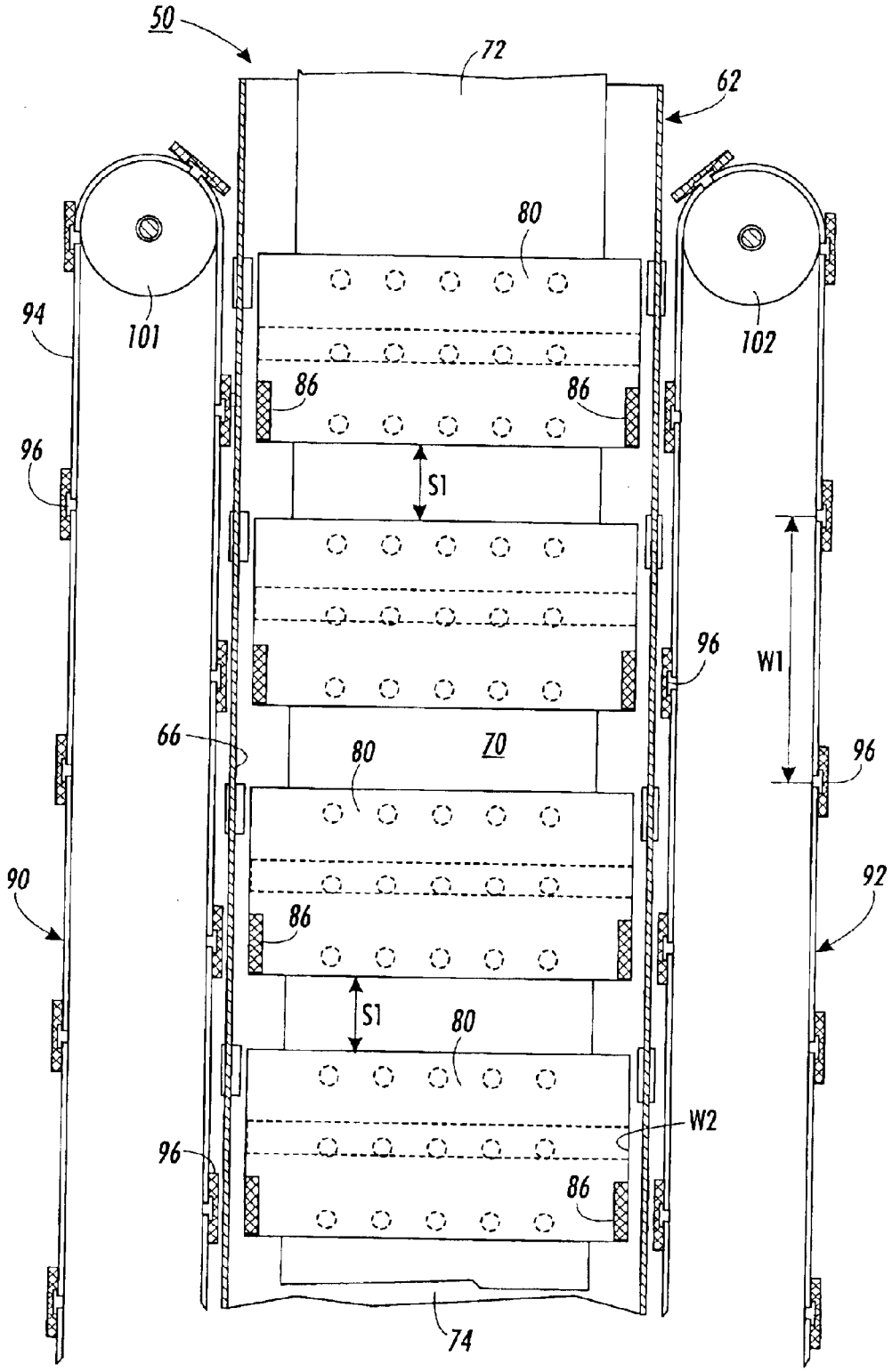
FIG. 4 is a schematic vertical section of the contamination-free, drying apparatus of the present invention.

Referring now to FIGS. 3 and 4, the contamination-free apparatus 50 is illustrated in detail, and is suitable for moving and drying coated photoreceptors in an efficient, non-contacting and contamination-free manner. The contamination free apparatus 50 as such consists of an oven assembly 60 including an oven 62 having first and second side walls 66, 68 defining a heating chamber 70 as well as an entrance 72 into, and an exit 74 from, the heating chamber. The oven assembly 60 also includes a guiding track 76 for guiding a photoreceptor carrier 80 into and out of the heating chamber 70, and first and second magnetic drive loops 90, 92, having first and second synchronized drive motors 100, 102 respectively, that are mounted for movement externally along the first and second side walls 66, 68 respectively. Each of the first and second magnetic drive loops 90, 92 includes first magnetic elements 96 for inducing magnetic forces through the first and second side walls 66, 68 into the heating chamber 70.

The contamination-free apparatus 50 also includes the carrier means or pallet 80 for holding a plural number of coated photoreceptors PR for movement through the heating chamber. The carrier means 80, for example, is made of a non-magnetic material such as aluminum, and includes (i) track following means 82 for moving over the guiding track 76 through the heating chamber 70, (ii) first and second end walls 83, 84 for facing the first and second side walls 66, 68 of the heating chamber, and (iii) second magnetic elements 86 mounted on each of the first and second end walls 83, 84 for coupling with said first magnetic elements 96 and enabling the first and second magnetic drive loops 90, 92 to magnetically move the carrier means 80 through the heating chamber 70 in a non-contact driving manner.

The contamination-free apparatus 50 further includes an air bearing assembly 110 for holding the track following means 82 out of contact with the guiding track 76 as the carrier means 80 is magnetically moved through the heating chamber 70. The air bearing assembly 110 includes sources of pressurized air 112 and first and second air bearing plates 114, 116 for receiving and reacting to pressurized air from the sources of pressurized air 112. The plates 114, 116 are mounted respectively on the first and second end walls 83, 84 for centering the carrier means 80 within the heating chamber 70. As pointed out above, the compressed or pressurized air 112 may need to be heated in order to maintain the oven temperature within desired specifications. The air bearing assembly 110 also includes a series of third air bearing plates 117, 118 mounted on a bottom wall 120 of the carrier means 80 for holding the track following means 82 out of contact with the guiding track 76.

Accordingly, the carrier means or pallets 80 rides on air bearing system 110 through the drying or curing oven 62 thus eliminating or preventing all moving components from contacting the load-bearing surfaces of the guiding track 76 within the oven. The air bearing system 110 includes bottom air bearings 117, 118 for lifting and holding each loaded carrier means or pallet out of load-contact with the guiding tracks within the oven 62. The air bearing system 110 also includes side air bearings 114, 116 for keeping the loaded carrier means or pallet 80 centered between the side walls 66, 68 of the oven, as well as from rubbing on the interior of such side walls.

Horizontal forward motion or movement of each loaded carrier means or pallet 80 through the heated chamber 70 of the drying or curing oven 62 is provided by the driven first and second magnetic drive loops 90, 92 coupling their first magnetic elements 96 with the second magnetic elements 86 on the ends of the carrier means 80.

As shown, each loop of the first and second magnetic loops 90, 92 each comprises a belt 94, and the first magnetic elements 96 are a series of powerful permanent magnets mounted at desired intervals W1 on the belt 94. Each of the driven first and second magnetic drive loops 90, 92 is continuous along its respective side wall 66, 68 of the oven, thus reducing the number of drive motors 101, 102 and associated controls. Each of the driven first and second magnetic drive loops 90, 92 are readily accessible from outside the oven 62 for preventive maintenance and repair. Bottom and side air bearings 117, 118 and 114, 116, function to keep the carrier means or pallet 80 from load-contact with, as well as centered on, the guiding track 76, thus eliminating any mechanical part-to-part rubbing and chance of he carrier means or pallet 80 catching and stalling inside the heated chamber. As such, no moving parts directly contact components inside the oven chamber 70. In this manner, the risk of contamination from foreign materials generated during the drying process is minimized.

The permanent magnets 96 on the each of the first and second magnetic loops 90, 92 are located at desired intervals W1. The interval W1 is significantly greater than a width W2 of each carrier means or pallet 80 so as to allow a small gap S1 between adjacent carrier means or pallets 80, 80 being moved through the oven 62. The small gap S1 minimizes binding, and allows for uniform air flow around each carrier means or pallet, thus enabling uniform heating and cooling of photoreceptors therein.

Referring again to FIGS. 1 and 2, after passing through the contamination-free drying apparatus 50, the dried or cured photoreceptors are unloaded, and the carrier means or pallet 80 is returned, via a conveyor assembly (not shown), to the commencement point of the dip coating cell 30.

As can be seen, there has been provided a contamination-free apparatus for moving and drying coated photoreceptors. The contamination free apparatus includes an oven assembly having first and second side walls defining a heating chamber, a guiding track for guiding a photoreceptor carrier or pallet, and first and second magnetic drive loops mounted externally of said first and second side walls. Each of the first and second magnetic loops has first magnetic elements for inducing magnetic forces into the heating chamber. The contamination-free apparatus also includes a carrier or a pallet for holding coated photoreceptors for movement through the heating chamber. The carrier or pallet includes track followers, first and second end walls for facing the first and second side walls of the heating chamber, and second magnetic elements. The second magnetic elements are mounted on the first and second end walls for coupling with the first magnetic elements and thus enabling the first and second magnetic loops to magnetically move the carrier means through the heating chamber. The contamination-free apparatus further includes an air bearing assembly for holding the track followers out of contact with the guiding track as the carrier or pallet is magnetically moved through the heating chamber.

While the embodiment of the present invention disclosed herein is preferred, it will be appreciated from this teaching that various alternative, modifications, variations or improvements therein may be made by those skilled in the art, which are intended to be encompassed by the following claims.

What is claimed is:

1. A contamination-free apparatus for drying coated photoreceptors, the contamination free apparatus comprising:

(a) an oven assembly including first and second side walls defining a heating chamber as well as an entrance into, and an exit from, said heating chamber;

(b) a guiding track for guiding a photoreceptor carrier into and out of said heating chamber;

(c) first and second magnetic drive loops mounted for movement externally along said first and second side walls respectively, each said first and second magnetic drive loops including first magnetic elements inducing magnetic forces through said first and second side walls into said heating chamber; and (d) carrier means for holding a plural number of coated photoreceptors for movement through said heating chamber, said carrier means including (i) track following means for moving over said guiding track through said heating chamber, (ii) first and second end walls for facing said first and second side walls of said heating chamber, and (iii) second magnetic elements mounted on said first and second end walls for coupling with said first magnetic elements and enabling said first and second magnetic drive loops to magnetically move said carrier means through said heating chamber.

2. The contamination-free apparatus of claim 1, including an air bearing assembly for holding said track following means out of contact with said guiding track as said carrier means is magnetically moved through said heating chamber.

3. The contamination-free apparatus of claim 1, wherein said carrier means is made of a non-magnetic material.

4. The contamination-free apparatus of claim 1, including first and second synchronized drive motors for driving said first and second magnetic drive loops.

5. The contamination-free apparatus of claim 2, wherein said air bearing assembly includes sources of pressurized air, and a plural number of air bearing plates mounted on said carrier means for receiving and reacting to pressurized air from said sources of pressurized air.

6. The contamination-free apparatus of claim 3, wherein said non-magnetic material comprises aluminum.

7. The contamination-free apparatus of claim 4, wherein said first and second synchronized drive motors each comprises and indexing drive motor.

8. The contamination-free apparatus of claim 5, wherein said plural number of air bearing plates includes first and second air bearing plates mounted respectively on said first and second end walls for centering said carrier means within said heating chamber.

9. The contamination-free apparatus of claim 5, wherein said plural number of air bearing plates includes a series of air bearing plates mounted on a bottom wall of said carrier means for holding said track following means out of contact with said guiding track.

10. Drying apparatus for drying coated photoreceptors, the apparatus comprising:

(a) a pallet for holding a plurality of photoreceptors, said pallet having a first end including a first magnetic member, and a second end including a second magnetic member;

(b) a drying oven assembly having (i) a base, (ii) a heat source, (iii) first and second side walls defining a heating chamber and a passage through said heating chamber, and (iv) a first air bearing system for keeping said pallet out of contact with said base during movement of said pallet through said heating chamber; and (c) first and second movable magnetic drive belt assemblies mounted externally and respectively of said first and second side walls of said drying oven assembly, each of said first and second movable magnetic drive belt assemblies including magnetic elements for coupling respectively with said first magnetic member and said with second magnetic member for moving said pallet, thereby moving said pallet and said plurality of photoreceptors therein in a non-contacting, contamination-free manner through said heating chamber.

11. The drying apparatus of claim 10, wherein said air bearing system includes sources of pressurized air, and a plural number of air bearing plates mounted on said pallet for receiving and reacting to pressurized air from said sources of pressurized air.

12. The drying apparatus of claim 11, wherein said plural number of air bearing plates includes first and second air bearing plates mounted respectively on said first and second end walls for centering said carrier means within said heating chamber.

13. The drying apparatus of claim 11, wherein said plural number of air bearing plates includes a series of air bearing plates mounted on a bottom wall of said carrier means for holding said track following means out of contact with said guiding track.

14. A contamination-free apparatus for drying coated photoreceptors, the contamination free apparatus comprising:

(a) an oven assembly including first and second side walls defining a heating chamber as well as an entrance into, and an exit from, said heating chamber;

(b) a guiding track for guiding a photoreceptor carrier into and out of said heating chamber;

(c) first and second magnetic drive loops mounted for movement externally along said first and second side walls respectively, each said first and second magnetic drive loops including first magnetic elements inducing magnetic forces through said first and second side walls into said heating chamber;

(d) carrier means for holding a plural number of coated photoreceptors for movement through said heating chamber, said carrier means including (i) track following means for moving over said guiding track through said heating chamber, (ii) first and second end walls for facing said first and second side walls of said heating chamber, and (iii) second magnetic elements mounted on said first and second end walls for coupling with said first magnetic elements and enabling said first and second magnetic drive loops to magnetically move said carrier means through said heating chamber; and (e) an air bearing assembly for holding said track following means out of contact with said guiding track as said carrier means is magnetically moved through said heating chamber, thereby moving said pallet and said plurality of photoreceptors therein in a non-contacting, contamination-free manner through said heating chamber.

* * * * *